US008578551B2

(12) United States Patent
Dahlén et al.

(10) Patent No.: US 8,578,551 B2
(45) Date of Patent: Nov. 12, 2013

(54) METHOD OF REBUILDING A SOOTBLOWING SYSTEM OF A RECOVERY FURNACE, A SOOTBLOWER FOR A RECOVERY FURNACE, AND A SOOTBLOWING SYSTEM INCLUDING A PLURALITY OF SOOTBLOWERS

(75) Inventors: Erik Dahlén, Göteborg (SE); Daniel Eliasson, Göteborg (SE)

(73) Assignee: Soottech Aktiebolag, Gothenburg (SE)

( * ) Notice: Subject to any disclaimer, the term of this patent is extended or adjusted under 35 U.S.C. 154(b) by 768 days.

(21) Appl. No.: 12/447,670

(22) PCT Filed: Nov. 2, 2007

(86) PCT No.: PCT/SE2007/050813

§ 371 (c)(1), (2), (4) Date: Apr. 29, 2009

(87) PCT Pub. No.: WO2008/057039

PCT Pub. Date: May 15, 2008

(65) Prior Publication Data

US 2010/0064470 A1 Mar. 18, 2010

(30) Foreign Application Priority Data

Nov. 6, 2006 (SE) ..... 0602350

(51) Int. Cl.

| | |
|---|---|
| ***A47L 5/38*** | (2006.01) |
| ***A47L 15/00*** | (2006.01) |
| ***F22B 37/52*** | (2006.01) |
| ***B08B 7/04*** | (2006.01) |
| ***B08B 9/00*** | (2006.01) |

(52) U.S. Cl.

USPC ..... 15/316.1; 15/318; 15/318.1; 122/390; 122/391; 122/392; 134/18; 134/167 R

(58) Field of Classification Search

USPC ..... 15/316.1, 318, 318.1; 122/390–392; 134/18, 167 R

See application file for complete search history.

(56) References Cited

U.S. PATENT DOCUMENTS

| | | | | |
|---|---|---|---|---|
| 5,416,946 | A * | 5/1995 | Brown et al. | 15/318 |
| 2006/0065291 | A1 | 3/2006 | Jones | |

FOREIGN PATENT DOCUMENTS

| | | | |
|---|---|---|---|
| JP | 11094233 | | 4/1999 |
| JP | 11094233 | A * | 4/1999 |
| JP | 2003156211 | | 5/2003 |
| WO | 96/08677 | | 3/1996 |
| WO | 2004/005834 | | 1/2004 |

OTHER PUBLICATIONS

Written Opinion and International Search Report issued in PCT/SE2007/050813.

* cited by examiner

*Primary Examiner* — Bryan R Muller

(74) *Attorney, Agent, or Firm* — Jeffrey S. Melcher; Manelli Selter PLLC

(57) ABSTRACT

This invention relates to a method of rebuilding a sootblowing system of a recovery furnace, said sootblowing system including a plurality of sootblowers (1), and each sootblower (1) including a frame (10), a moveable carriage (14) supported by the frame (10), a motor (2) for moving the carriage (14), a lance tube (11) mounted on the carriage (14) to be insertable into and retractable from the recovery furnace (8), said lance tube (11) having at least one nozzle (12), and a steam feed tube (45, 35, 15) connected to the lance tube (11) for feeding sootblowing steam to be ejected through said at least one nozzle (12) into the recovery furnace, said steam feed tube (45, 35, 15) having a first valve (3) arranged to admit steam through said at least one nozzle (12) only when the carriage with the lance tube (11) is in an activated position, i.e. during retraction and introduction of the lance tube (11), wherein further providing means (4, 30) to arrange for controlled steam supply merely during a limited time period, e.g. merely during introduction.

13 Claims, 7 Drawing Sheets

METHOD OF REBUILDING A SOOTBLOWING SYSTEM OF A RECOVERY FURNACE, A SOOTBLOWER FOR A RECOVERY FURNACE, AND A SOOTBLOWING SYSTEM INCLUDING A PLURALITY OF SOOTBLOWERS

CROSS-REFERENCE TO RELATED APPLICATIONS

This application is a national stage entry under 35 U.S.C. 371 of International Application No. PCT/SE2007/050813, filed 2 Nov. 2007, designating the United States. This application claims foreign priority under 35 U.S.C. 119 and 365 to Swedish Patent Application No. 0602350-1, filed 6 Nov. 2006.

TECHNICAL FIELD

The present invention relates to a method of rebuilding a sootblowing system of a recovery furnace, said sootblowing system including a plurality of sootblowers, and each sootblower including a frame, a moveable carriage supported by the frame, a motor for moving the carriage, a lance tube mounted on the carriage to be insertable into and retractable from the recovery furnace, said lance tube having at least one nozzle, and a steam feed tube connected to the lance tube for feeding sootblowing steam to be ejected through said at least one nozzle into the recovery furnace, said steam tube having a valve for admitting steam through said at least one nozzle only when the carriage with the lance tube is moving, i.e. has left its inactive/start position. The present invention also relates to a sootblower arrangement as such and a recovery furnace including a plurality of sootblower arrangements, wherein at least one sootblower is the one referred to above.

BACKGROUND ART

In pulp industry, recovery furnaces are used as a chemical reactor and for the production of steam for internal use, for generation of electricity, and for sale. As the recovery furnace operates as a chemical reactor, the combustion conditions differ from those of an ordinary boiler, in that the heating surfaces of the furnace get covered extremely rapidly with combustion deposits, i.e. slag, ash and/or soot, which decrease the efficiency of the recovery furnace, particularly by reducing heat transfer in the furnace. In addition to soot, the flue gases contain inorganic chemicals, which condense on the heating surfaces of the recovery furnace.

Recovery furnaces require continual cleaning of the heating surfaces by means of special cleaning apparatus, called sootblowers. The sootblowers clean the heating surfaces with high pressure steam, and generally about 2-10% of the steam production of the furnace is used for cleaning the recovery furnace. If the time between successive cleanings is too long, the dust-like particles get harder and/or sinter, and the deposits will be harder to remove.

Generally, the sootblowing system comprises about 40-80 sootblowers and is very expensive subsystem of a recovery furnace. As a rule, each individual sootblower is activated at regular intervals, generally between about 45-300 minutes. A correctly operating sootblowing system is of vital importance to the total economy of a mill, as the value of the consumed steam is high, and also as it is not uncommon that the mill has to stop its entire production of pulp for water washing the heating surfaces of the recovery furnace.

For a long time, the mills have desired to reduce the steam consumed by sootblowing. However, in principle this has been very difficult, as reduced steam consumption also has meant reduced soot removal efficiency. In many applications reduced soot removal efficiency is unacceptable, when you seek to attain high/secure/increased availability on the recovery furnace. Thus, there is a long-felt demand for a solution that makes it easy to save steam and simultaneously increase the efficiency of the sootblowing.

A principle description of a recovery furnace is found in WO 96/08677, which also discloses the use of sootblowers for removing heavy deposit, which is wholly or partially sintered, from the heating surfaces in a recovery furnace.

Several concepts of making the removal of soot more efficient have been presented and commercialized. In a first concept, the soot removal is governed by requirements. The operational intervals of the sootblowers are controlled from the calculated accumulation of soot on the heating surfaces. The saving of steam is achieved by breaks/pauses in the sootblowing, but often this is not acceptable to mills.

In a second concept, as depicted in U.S. Pat. No. 5,416,946, the sootblowers are operated with a reduced pressure (often in combination with a higher speed) during the return stroke or vice versa. As the pressure reduction between the steam source and the sootblowers is carried out at one common, single location, the sootblowers have to be operated one by one. This method saves steam, but simultaneously it reduces the efficiency of the sootblowing system somewhat. A similar solution is also known from US 20060065291, but intended for use in a different kind of boilers/furnaces, i.e. small sized.

In a third concept, the recovery furnace is divided into two (or more) sootblowing steam systems (front and back), where the sootblowers of one system can be operated independently of those in the other system. This method also has been combined with the first and second concepts above. The solution is complicated technically, as it includes much piping, new control stations and extensive programming to operate well from a process engineering point of view. Additionally, in practice the method is restricted by the existing construction of the trunk pipes that supply steam to the sootblowers. In practice, as a result of this restriction, the efficiency of the soot removal can be increased by at most about 30-50%.

DISCLOSURE OF THE INVENTION

The object of the present invention is to reduce the consumption of steam for sootblowing in recovery furnaces without reducing the soot removal efficiency, which is achieved by a method and arrangement respectively, according to the claims of the invention.

Thanks to the invention drastic savings concerning steam consumption may be achieved and also in combination therewith improved heat exchange efficiency.

According to further aspects of the invention:

said directionally controlled valve or control means is arranged to only enable sootblowing by said lance tube either during introduction or retraction thereof, and to, at least substantially, close supply of steam to said lance tube, during at least a substantial part of either the retraction or introduction thereof, which is a principle of performing sootblowing according to the invention that simplifies the manner of achieving the above mentioned advantages, a control system, to control that during overlapping movements, introduction of a first lance tube a second lance tube is being retracted and to control that, for at least the main part, preferably substantially all, of the only one of said first and second lance tubes may perform sootblowing at a time, which provides the advantage that a substantially equal amount of steam is consumed in total, thereby eliminating (or at least minimize) peaks and dips of the pressure in the main supply.

a throttled bypass is provided to permit a reduced flow of steam to pass by, or through, the directionally controlled valve to cool the lance tube when the directionally controlled valve is in its closed state, which provides the advantage of easy arrangement of cooling of the lance tube which in some installations may be required.

The invention also relates to sootblowing arrangement according to claim 5, presenting essential features that are required to obtain the advantages according to the invention.

According to further aspects of such an arrangement:

a control arrangement is arranged to control when said directionally controlled valve is set in its open state and closed state respectively, which provides for automation of the surveillance of an arrangement according to the invention.

said control arrangement includes sensing means arranged to identify a position and/or direction of movement of said lance tube, which provides the advantage of achieving a high degree of reliability to control efficiently.

said sensing means includes electronic and/or optical sensing means, which provides the advantage that the use of that kind of sensing means may further improve the reliability and especially so if not including any parts that are subjected to wear.

said control arrangement includes a control unit, which provides the advantage that increased flexibility and more complex control strategies may be used to further improve efficiency based on different/various sets of parameters, e.g. optimizing total economy of a recovery furnace.

said control arrangement includes mechanically operated devices, which provides the advantage that in some applications existing devices may be reused and/or due to being desirable based on other aspects, e.g. existing infra structure, existing know-how of operators, etc.

BRIEF DESCRIPTION OF THE DRAWINGS

In the following, the invention will be described in more detail with reference to preferred embodiments and the appended drawings, wherein.

DETAILED DESCRIPTION OF THE INVENTION

Figure 1:
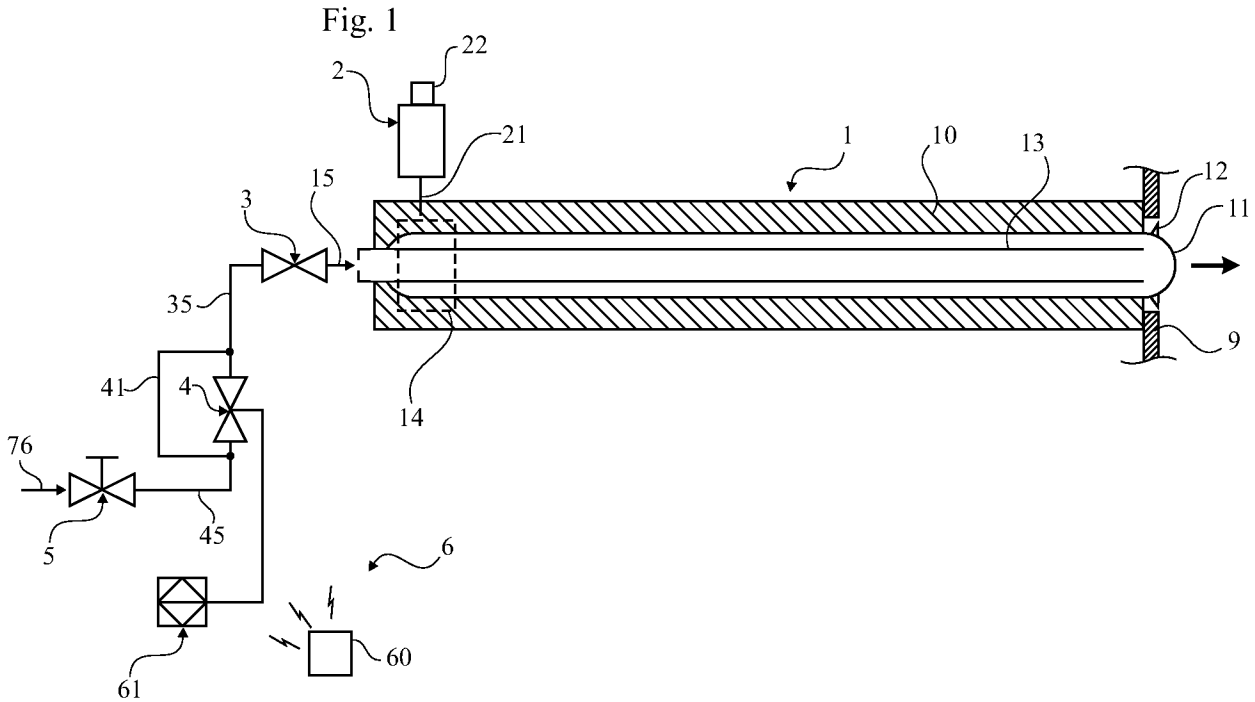
FIG. 1 is a schematic view of one embodiment of a sootblower in accordance with the present invention and having a lance tube in an end position and just starting its insertion into the recovery furnace.

FIG. 1 schematic views of one embodiment of a sootblower arrangement 1 having a lance tube 11 retracted into an end position and just starting its insertion into the recovery furnace, the outer wall of which is designated 9. The sootblower arrangement 1 includes a frame 10, a moveable carriage 14 supported by the frame 10, and a motor 2 for moving the carriage (in a manner not shown) via a drive shaft 21. The lance tube 11 is mounted on the carriage 14 to be insertable into and retractable from the recovery furnace, and it has at least one but preferably two nozzles 12 for ejecting steam. The lance tube 11 surrounds an interior steam feed tube 13, to which an external steam feed tube 45, 35, 15 is connected for feeding sootblowing steam to be ejected through said at least one lance tube nozzle 12 into the recovery furnace. A manually operated valve 5 that normally is put in its open position, but in some situations, e.g. in connection with maintenance, may be closed. At the outlet of the manually operated valve 5, there is a steam line 45 that leads to a directionally controlled valve 4. At the outlet of the directionally control valve 4 there is a steam line 35 leading to an on/off valve 3 having an outlet steam line 15 that is connected to the interior steam feed tube 13.

Accordingly the on/off valve 3 (e.g. a poppet valve, which valve however can also be of any other valve kind, e.g. a control valve) for admitting steam through said at least one nozzle 12 when the carriage 14 with the lance tube 11 is in its activated state, i.e. being moved into and out of the recovery furnace respectively, wherein the first valve 3 belongs to a sootblowing arrangement that was fitted in the recovery furnace prior to a rebuild according to the invention. The lance tube 11 generally rotates during insertion and retraction and may be rotationally driven by the motor 2 or by a separate drive. Further, the speed in one direction may be higher than in the other direction, e.g. the retraction speed may be higher than the insertion speed. A phase direction sensor 22 is arranged in connection with the motor 2, which sensor 22 senses the phase direction, i.e. the direction of rotation of the motor 2, and thereby may be used to detect the direction of movement of the lance tube 11. A control system unit 6, e.g. including a PLC 61 and/or a central server 60, is used to control the sootblowing based on detected sensor signals detected from applied sensors, (e.g. the phase direction sensor 22).

In accordance with the present invention, the consumption of steam for sootblowing in a recovery furnace is reduced without reducing the soot removal capacity (indeed possibly even increasing the capacity), by either providing the directionally controlled valve 4 in the steam tube 45, 35 upstream of the first valve 3 (see FIGS. 1, 2 and 4 and most arrangements in FIG. 3) or substituting the directionally controlled valve 4 for the first on/off valve 3 (see FIG. 3, right hand row) or arranging for means 30 to control the first valve 3 in a novel manner.

Figure 2:
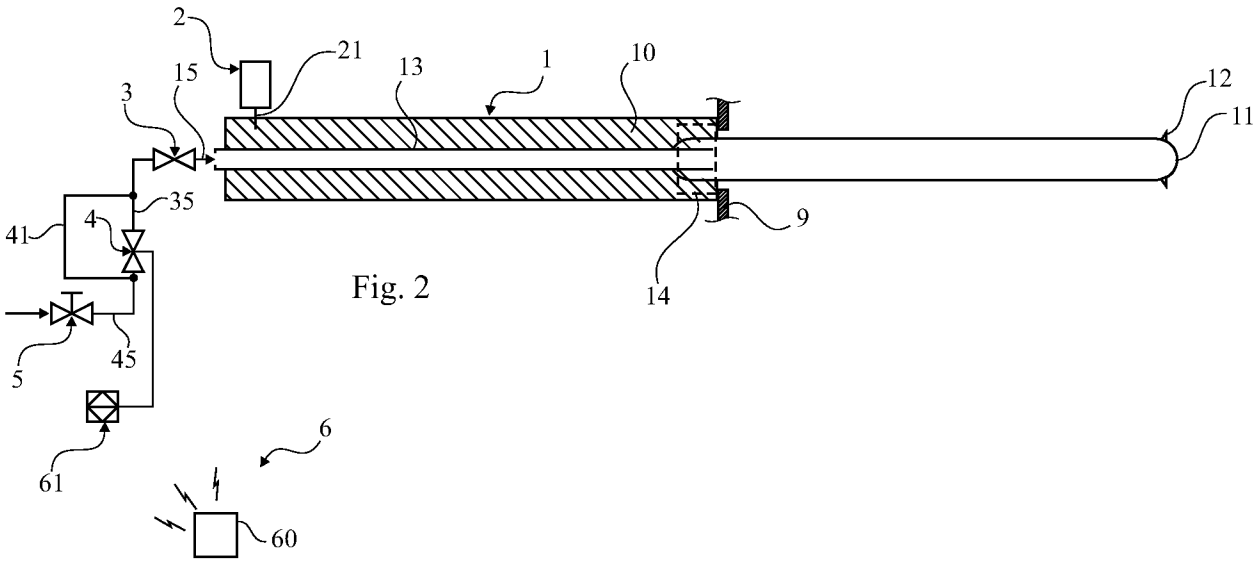
FIG. 2 is a schematic view of the sootblower of FIG. 1 having the inserted lance tube in its other end position.

In FIGS. 1 and 2 there is presented an embodiment where the second valve 4 is directionally controlled, such that it is open on insertion of the lance tube 11 but closed on retraction of the lance tube 11. Further, a throttled bypass conduit 41 is provided to permit a reduced flow of steam to pass the directionally controlled valve 4 to cool the lance tube 11 during the retraction thereof. (Alternatively the throttled bypass may be a conduit provided internally in the directionally controlled valve 4). The on/off valve 3 upstream of the directionally controlled valve 4 may be used for preventing leakage of steam through the bypass conduit 41 and accompanying steam losses when the lance tube 11 is fully retracted and inactive. Reference numeral 6 designates a PLC (Programmable Logic Controller) for opening and closing the directionally controlled valve 4.

An arrangement according to the invention, as presented schematically in FIGS. 1 and 2, functions in the following manner. A central control unit 60, which initiates start of the motor 2 and opens the on/off valve 3 by means of providing signals to the switch mechanisms (not indicated) of each one of the motor 2 and the on/off valve 3 respectively. At the same time as the motor 2 starts to move the lance tube 11 into the recovery furnace a sensing unit 22 that senses the phase direction of the motor 2, will signalize to the PLC 6 that the lance tube is moving into the recovery furnace and as a consequence the PLC 6 will initiate opening of the directionally controlled valve 4. The manually operated valve 5 (as is normally the case) is set in its open position. Accordingly steam will be supplied into the interior steam tube 13 thereby supplying steam with full pressure through the nozzle 12. During all of the travel of the lance tube 11 from its interior position shown in FIG. 1, to its fully extended position shown in FIG. 2, steam will be supplied to achieve efficient sootblowing of the heat exchanging surfaces of the recovery furnace. Now the central control unit 60 will receive some kind of sensor signal (that can be based on a big variety of sensing devices an/or measuring devices) that the lance tube 11 has reached its turning position, and as consequence it will provide the control mechanism of the motor 2 to change the phase direction of the power supply, thereby initiating retraction of the lance tube 11. At the same time as the phase direction of the motor 2 is changed the phase direction sensing device 22 will signalize to the PLC (and/or central control unit 60) to initiate closure of the directionally controlled valve 4. Accordingly the valve 4 will shut off the steam supply to the lance tube 11, such that the retraction is performed without any sootblowing. In order to cool the lance tube during retraction a minor amount of steam is supplied also during retraction, by means of the bypass 41, bypassing the directionally controlled valve 4. When the lance tube 11 reenters into its innermost position, this will be signalized to the central control unit 60 and the on/off valve 3, thereby closing the on/off valve 3 and stopping the motor 2. Further, according to the preferred manner of operating a sootblowing system according to the invention, at the same time as the steam supply to the lance tube 11 described above is stopped, the central control unit 60 will initiate sootblowing by another (e.g. neighboring, see FIG. 3) sootblower 1'. Accordingly the central control unit 60 will initiate an opening of the on/off valve 3' of the neighboring sootblower 1', initiate start of that motor 2' and also initiate opening of the directionally controlled valve 4 in an overlapping manner such that when the steam supply to the first sootblower 1 is closed the steam supply will start to feed into the neighboring sootblower 1'. Accordingly the two lance tubes 11 (and 11', not shown) will move in opposite directions, i.e. when the first lance tube 11, starts to retract the other one starts to move inwards. As a consequence a double amount of cleaning (or more due to less sintering) will be achieved with the same amount of steam, compared to a traditional manner of operation.

Figure 3:
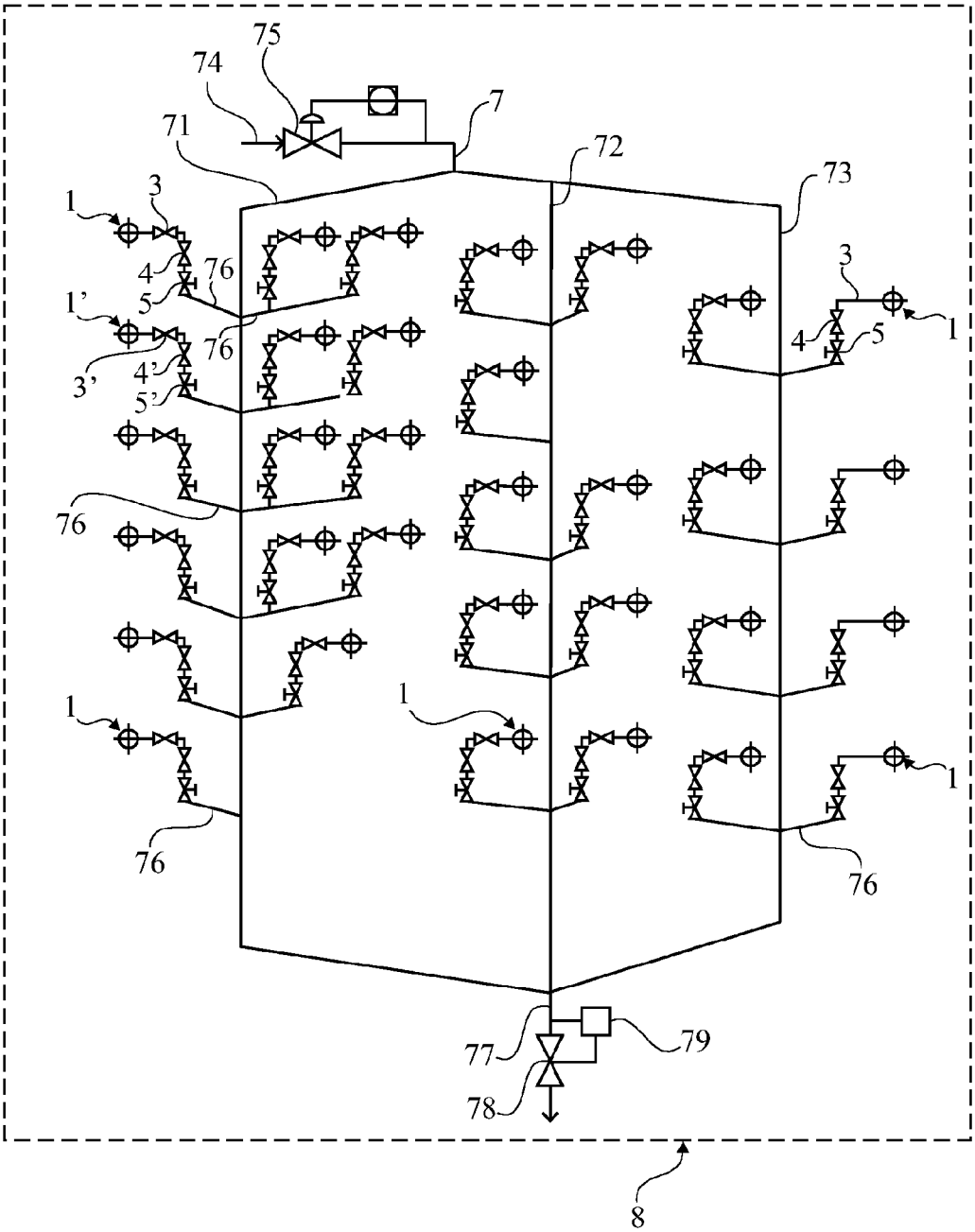
FIG. 3 is a schematic view of a steam system having a plurality of sootblowers of FIGS. 1 and 2 for soot removal in a recovery furnace.

A sootblowing system for a recovery furnace 8 and including a plurality of sootblowers is shown in FIG. 3. The recovery furnace 8 schematically shown as such is, but it has a superheater, a convection section, and an economizer, on the heating surfaces of which deposits are to be removed by sootblowing. As most recovery furnace are very wide, the shown system is intended for the right-hand side of the furnace, and an identical system is to be mounted on the left-hand side of the recovery furnace (which of course is not needed if the furnace is narrow). Steam is supplied from a suitable source through pipe 74 to a reduction valve 75, where the pressure is reduced to a level suitable for sootblowing, and from valve 75 through a pipe 7 to a plurality of generally vertical branch manifolds 71, 72, 73. In the shown embodiment there are three branch manifolds, a first one 71 for the superheater, a second one 72 for the convection section, and a third one 73 for the economizer. A plurality of steam feed tubes 76 are connected to the branch manifolds 71, 72, 73 for feeding steam to the sootblowers 1. These steam feed tubes 76 lead to the manually operated valve 5 of FIG. 1, but as illustrated in FIG. 3, some of the steam feed tubes 76 in the superheater (of course this my also be applied in any other part of the furnace) may feed steam to more than one sootblower 1. In the shown embodiment, there are 15 sootblowers 1 in the superheater, 9 sootblowers in the convection section, and 8 sootblowers in the economizer. Of course, other numbers of sootblowers may be used, if desired. At the bottom of the branch manifolds 71, 72, 73, they are connected to a common outlet pipe 77 having a drain valve 78 for drainage of the steam system (again, it is evident that this may be varied, e.g. having a drain on each manifold instead). The drain valve 78 may be controlled by a temperature controller 79 or other standard equipment. As shown most of the sootblower arrangements are designed as described in the embodiment presented in FIGS. 1 and 2. As indicated above one of the sootblower arrangements 1' has been given a different reference numerals in order to be able to clearly present a preferred principle (se above, page 7) of performing sootblowing according to the invention. Further it is also presented in FIG. 3 that within the ambit of the invention, as has been mentioned above, there is mostly no need for more than one valve 4 to achieve the function according to the invention, which is presented in the right hand row of the sootblowers belonging to the economizer. Further, in this section where the temperature is lower there may be no need for cooling during retraction, i.e. eliminating the need of a bypass.

Figure 4:
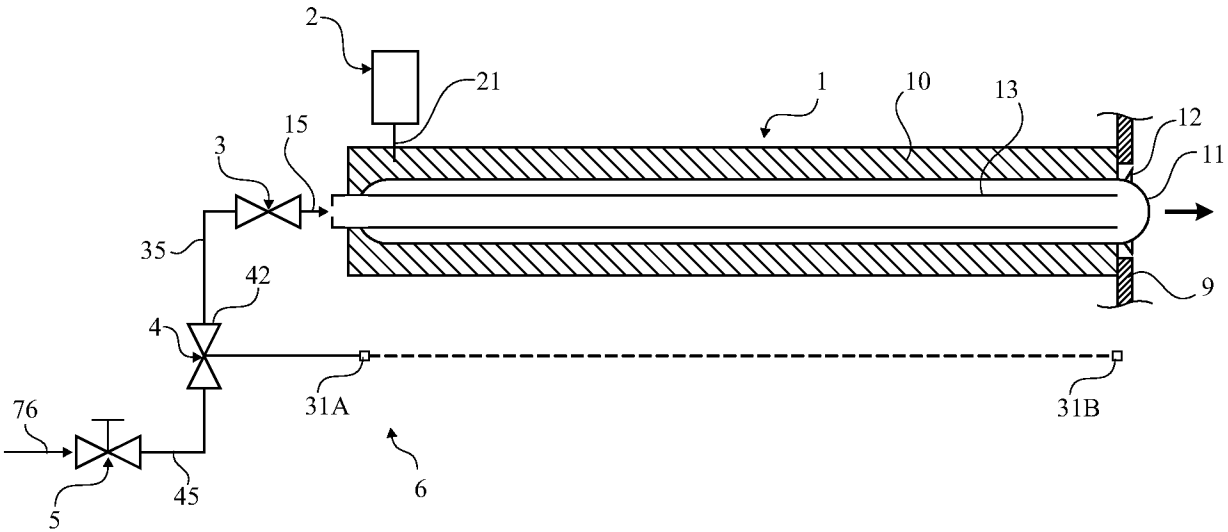
FIG. 4 is a schematic view of a modification of the sootblower of FIG. 1 having limit switches for controlling steam flow through the lance tube.

In the embodiment shown in FIG. 4, the sootblower 1 has two limit switches 31A, 31B, one at each end position of the lance tube 11, e.g. mechanical switches or optical switches or inductive sensor switches, etc. The signals from these limit switches 31A, 31B are transferred directly to the drive mechanism (not shown) of the directionally controlled valve 4 or other control device (not shown), which is used to determine lance tube travel direction and/or effect order, and which is used for ordering the directionally controlled valve 4 to open or close. Further FIG. 4 presents a restriction device 42 applied to the valve 4 which in some applications beneficially may be used in order to reduce the flow, e.g. to allow a reduced amount of steam in some positions of the furnace, e.g. the economizer.

Figure 5:
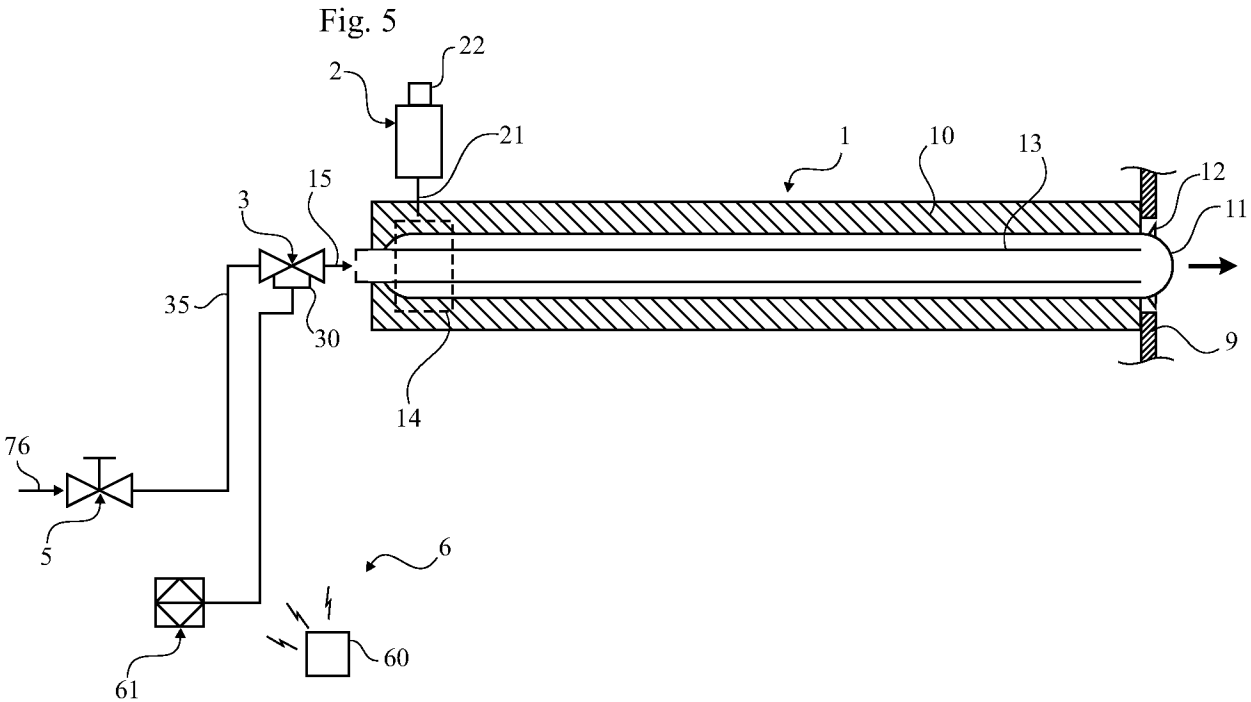
FIG. 5 is a schematic view of modification of the sootblower of FIG. 1, wherein an existing poppet valve has been used to achieve the function according to the invention.

In the embodiment shown in FIG. 5, the sootblower arrangements 1 makes use of the existing poppet valve 3 (or indeed a new poppet valve) to achieve the function according to the invention. Since an existing poppet valve 3 of today's technology are mechanically operated, normally mechanically controlled by a device connected to the carriage 14, which device opens the poppet valve 3 when the carriage leaves its innermost position (moves into its activated stage). Accordingly a traditional poppet valve 3 as such may not be used to achieve a function according to the invention. However, in the embodiment shown in FIG. 5, the poppet valve 3 has been fitted with a closure means 30, that is arranged with a moveable device (not shown) that has the same effect as the device connected to the carriage 14. Accordingly the moveable device of the closure means 30 will facilitate closure of the poppet valve 3 independent of the position of the carriage 14. By connecting that closure means 30 to PLC 61 or central control device 60, the sootblower according to FIG. 5 may be operated in a manner according to the invention.

There is also a plurality of other possibilities of operating the directionally controlled valve 4 to control its shutting off and opening of the steam flow to the lance tube 11. By way of example, the direction of rotation of the lance tube 11 may be detected by any suitable mechanical device and/or a time based triggering possibly without any need to sense direction or position of the lance tube 11. There are also many different possibilities of mechanical influence, and direct drive of actuator through parallel drive of sootblower motor 2, and various combinations of the above stated ways.

As a general rule the understanding according to prior art sootblowing, is such that about 90% of the cleaning occurs during the insertion of the lance tube 11, and the remaining 10% during the retraction of the lance tube 11. By providing the directionally controlled valve 4 in accordance with the invention directly on the sootblower 1, or more precisely in the steam feed pipe 45, 35, 15 just upstream of the sootblower 1, it is possible to shut off the steam flow during any desired period of the activated lance tube 11, preferably a moving lance tube 11, e.g. during the retraction of the lance tube 11 or vice versa, i.e. during insertion. This operating method cuts the steam consumption by 50% simultaneously as the efficiency of the soot removal remains at 90%. The association of each sootblower with a separate second on/off valve 4 makes it possible to operate a plurality of sootblowers simultaneously, independently of the travel direction of one another, which provides a significant advantage in accordance with the invention.

The sootblowers 1 are operated at regular intervals (about 45-300 minutes) to continually remove deposits from the heating surfaces. The deposits, which have a dust-like consistency when landing on the heating surfaces, are sintered by the heat during the cleaning intervals. Hard, sintered deposits make the recovery furnace clog slowly and as a consequence of the sintering a furnace has to be stopped for cleaning. By parallel operation of two sootblowers 1, the time between the cleaning occasions is halved, so that in most applications the deposits will have no time to sinter between the cleaning occasions, when performing sootblowing according to the invention. The resulting effect is that increase in efficiency can be seen to increase more than 100%, since the long-time building-up/sintering often may be completely prevented, since the furnace more rarely (or indeed in some applications never) has to be stopped for cleaning and since a more efficient cleaning of the heat exchange surfaces will increase the heat transfer, i.e. reduced the U value. The present invention makes parallel operation of two or more sootblowers 1 possible, and to have no or a reduced flow of steam through the lance tubes 11 during desired/preset period/s in their active state (i.e. normally moving in or out). If two sootblowers 1 continually are operated simultaneously, this results in an efficiency increase of more than 100% without increasing the steam consumption.

By introducing delayed starting, so that "the next sootblower 1''' does not start directly (or is given a break/pause) upon the reversal of the first lance tube 11 to retract outside of the furnace, it becomes possible to steplessly and simultaneously adjust the steam consumption together with the efficiency.

As a way of example the stepless adjustment makes it simple to adjust to soot removal (assuming that all sootblowers move at the same speed) between the following levels:

Low steam consumption level;

- Only one sootblower 1 at a time is operated.
- 50% reduced steam consumption for soot removal.
- 90% soot removal efficiency retained.

High soot removal efficiency level;

- Two sootblowers 1 are always operated simultaneously (i.e. a new starts when the preceding starts turns back):
- The same steam consumption as in normal soot removal.
- More than 100% increase soot removal efficiency.

A middle level, that on operation may be assumed to involve;

- Starting the lance tube 11' of "the next sootblower 1''' when that of the preceding lance tube 11 is halfway back.
- 33% reduced steam consumption for soot removal.
- More than 33% increased soot removal efficiency.

Figure 6:
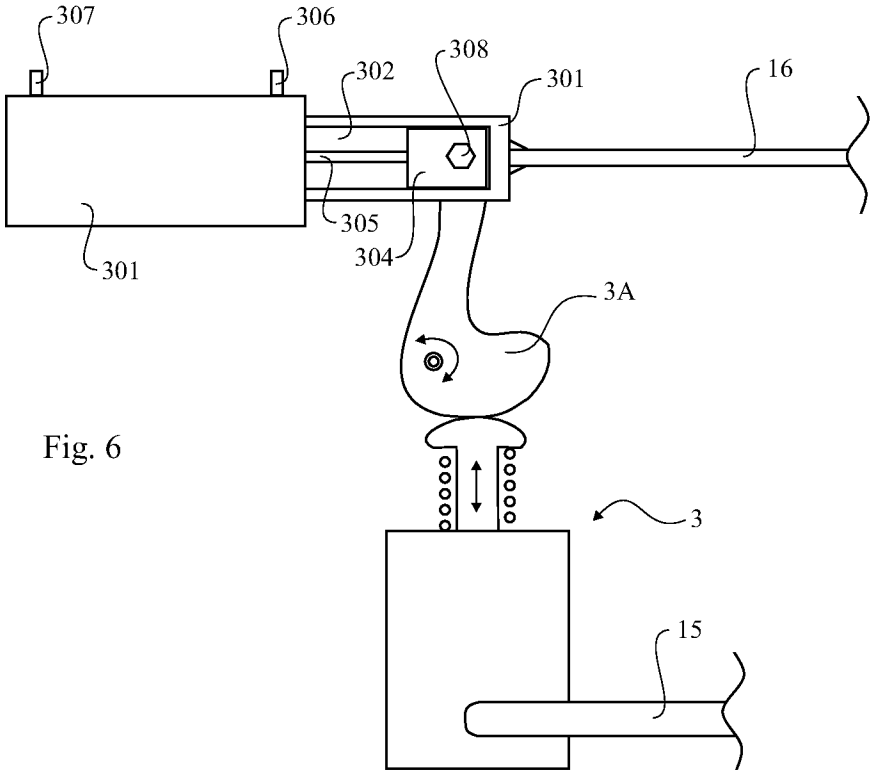
FIG. 6 shows a specific example of an embodiment regarding a mechanical control device that may be used to arrange for a solution as depicted in FIG. 5, FIG. 7 schematically shows a solution to more or less use pneumatic devices to achieve functionality in accordance with the invention.

In FIG. 6 there is shown a specific embodiment of the closure means 30 as schematically described in relation to FIG. 5. As already mentioned in connection with FIG. 5, this kind of solution is based on using the existing poppet valve 3 in combination with a closure means 30, which eliminates the need for further valve unit. As is well known the existing poppet valve 3 normally will be in its closed position by means of a spring urging the valve stem into a closing position. A lever 3A is pivotally attached to facilitate movement of the valve stem (downwardly in FIG. 6) and thereby open the valve 3, when the lever 3A is pivoted to the right in FIG. 6. In many known installations the activation of the lever 3A is performed by means of a rod device 16 that is caused to move to the right and be in a locked position (by an excenter locking device) once the carriage 14 and the lance tube 11 have left the resting position. Hence it will remain in that locked position until the carriage and lance tube 14, 11 returns. Accordingly, as already has been described in relation to the known prior art, the poppet valve 3 will remain in its open position all the time when the lance tube 11 and carriage 14 travels forth and back.

In the embodiment shown in FIG. 6 the existing control mechanism is maintained. However, the rod 16 is not attached directly to the lever 3A but to a positioning device 301, which in turn is fixedly attached to a piston/cylinder unit 303. The positioning device 301 extends longitudinally and coaxially with the piston cylinder unit 303 and has a slot 302 formed therein. Slideably within the slot 302 there is arranged a positioning body 304, which has an extension that is less than half the length of the slot 302 to allow for the body 304 to move within the slot. The body 304 is fixedly attached to the piston 305 of the cylinder piston unit 303. Accordingly the positioning body 304 may be moved forth and back within the slot 302 by means of the piston cylinder unit 303. Further the whole piston cylinder unit 303 and positioning device 301 may be moved forth and back by means of the rod 16. The lever 3A of the poppet valve 3 is at its top end pivotally connected to an attachment device 308 which in turn is fixedly attached to a positioning body 304. Further there is shown connections 306, 307 for supply of pressurized air to the piston cylinder unit 303 to facilitate movement in either one of the directions and also in some embodiments to achieve positioning of the positioning body 304 in a desired position.

The function of the embodiment shown in FIG. 6 is as follows. When the carriage, lance tube 14, 11 are in their resting position the rod 16 will be positioned in its outermost position and also fixed in that position. In this position the positioning device 301 and the positioning body 304 are arranged such that the poppet valve 3 may not be opened by means of activation of the cylinder piston unit 303, since also in the most right hand side position of the positioning body 304 within the slot 302 no activation of the lever arm 3A will be achieved, i.e. it will not be possible to cause opening of the poppet valve 3. Accordingly the positioning device 301 and positioning body 304 are arranged in such a manner in relation to the lever 3A of the poppet valve that the poppet valve 3 will remain in its closed position regardless in which position the positioning body 304 is put within the slot 302.

Once the carriage 14 and the lance tube 11 starts to move (which in this case will be in the right hand direction, seen in FIG. 6) the rod 16 will move to its activated position, i.e. moving to the right, to its innermost position. Now the poppet valve 3 may be activated by means of the closure device 30. However, thanks to the positioning device 301 and the ability to move the positioning body 304 by means of the cylinder piston unit 303 the poppet valve 3 may also be closed when the rod 16 is in its activated position. To open the valve 3, the positioning body 304 is caused to move to the right in the figure, to cause the lever 3A to pivot and to open the poppet valve 3, whereby steam will enter into the lance tube 11 via the piping 15. Hence the valve 3 will be fully opened when the body 304 is in its outermost position, i.e. in the end position of the slot 302 furthest away from the cylinder piston unit 303.

If the cylinder/piston unit 303 is applied with pressurized air in supply connection 306 the piston 305 will be moved to the left and thereby move the positioning body 304 and lever 3A to the left, whereby the valve 3 will be closed. In an intermediate position a restricted flow of steam may be achieved.

Hence, by controlling the supply of pressurized air to the connections 306, 307 any desired mode of the poppet valve 3 may be achieved, once the rod 16 is in its innermost position. For instance the control system may be arranged to supply pressurized air into supply connection 307 from the beginning once the carriage and lance tube 14, 11 start to move, to keep the poppet valve 3 open all the time during the travel outwards. Once the end position is reached a sensor device 31B will supply a signal to the control unit (not shown) which will cause pressurized air to be supplied to the other supply connection 306 whereby the piston 305 will move inwards to thereby cause the poppet valve 3 to close and as a consequence no steam will be supplied during return to stroke. As is well understood, it is also possible to use the cylinder piston unit 303 to position the piston 305 in an intermediate position, during e.g. the return stroke, to thereby supply sufficient steam for cooling, if needed. In this regard it is well understood by the skilled person that thanks to the invention merely a limited number of the lance tubes 11 may be supplied with the cooling steam whereas some others not, e.g. depending on where in the recovery boiler the lance tube 11 is being used. As is well established, some places within the boiler are much hotter than others and accordingly cooling is not necessary always and not everywhere. Thanks to the invention this may be individually optimized for each boiler to merely allow supply of cooling steam where it is desired necessary, thereby saving further steam.

It is evident for the skilled person that many different solutions may be used to achieve functionality as specifically described in relation to FIG. 6. For instance a variety of positioning/power sources may be used such as hydraulic cylinder piston units, electrical units, etc. Further it is understood that also other mechanical connections may be used instead of a rod 16, e.g. some kind of wire or chain mechanism to position the positioning device 301 in a corresponding manner as the rod 16. Further it is understood that instead of mechanical means connected to the lance tube/carriage 11, 14 electrical sensors may be used to provide the function of the positioning of the rod 16, e.g. some kind of switch that merely would supply power to the mechanical means 30 once the carriage 14 has left in its resting position.

Figure 7:
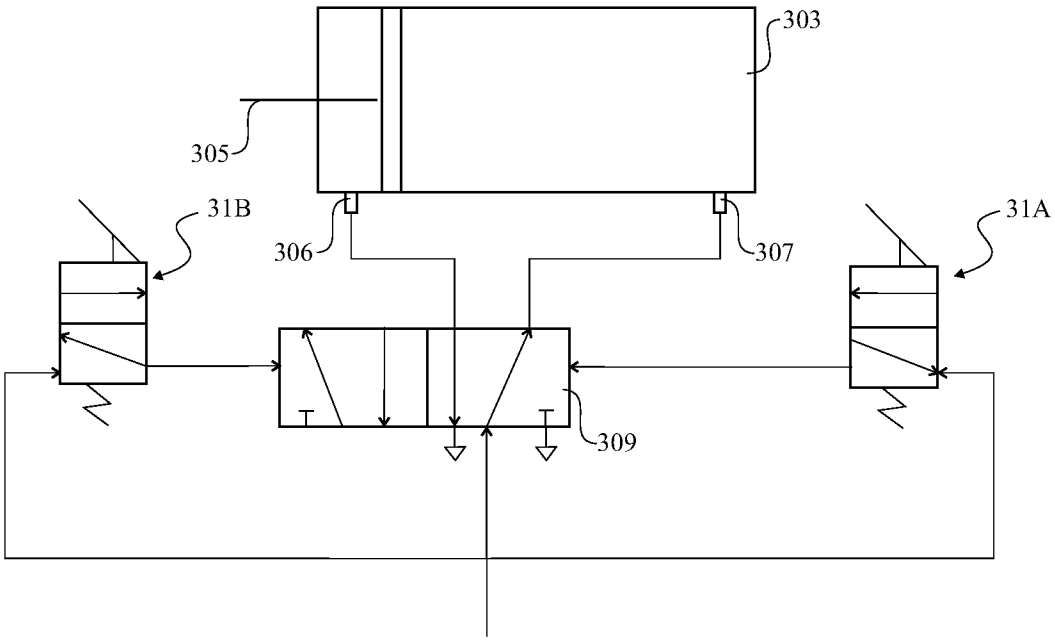

In FIG. 7 there is shown in a schematical manner that the invention may be used in connection with a control system that is pneumatically operated, whereby the need of further control functions at the sootblower 1 will be minimized. There is shown that both the innermost limit switch 31A as well as the outermost limit switch 31B are operated, by means of a lever device that can cause a pneumatic valve to be set in one of two positions. Further there is shown a control valve 309 that is connected to the supply lines leading to the connections 306, 307 of the piston/cylinder unit 303. A common pressurized air supply is arranged, to both the lines where the limit valves 31A, 31B are arranged and also where the central control valve 309 is positioned. As already described, in its resting position, the poppet valve 3 will be in its closed position. Once the lance tube 11 starts to move it will cause the innermost limit switch 31A to pivot downwards whereby air will pass through said control valve 31A and thereby position the central control valve 309 in a first position whereby pressurized air will be supplied to the connection 307 that will cause the piston 305 to move to open the poppet valve 3. Once the lance tube 11 has reached its end position it will cause the outer limit switch 31B to pivot and thereby allow its corresponding valve to open, whereby the central control valve 309 will move to its second position (i.e. to the right in FIG. 7) whereby pressurized air will be supplied to connection 306. As a consequence the piston 305 will move inwards and cause the poppet valve to close. As is well understood for the skilled person in the art this is merely a schematic example to illustrate that the functionality of the invention may be achieved with any different kinds of control devices and accordingly at a big variety of different kind of devices and combinations thereof may be used to achieve the functionality to obtain the basic advantages according to the invention.

INDUSTRIAL APPLICABILITY

The present invention is not restricted to the preferred embodiments described above but can be varied within the scope of the appended claims. For example, the invention may be used for rebuilding existing sootblowing systems of the kind having a front system and a rear system, where the systems may operate with mutual differing steam pressures, and the sootblowers in one system may be operated independently of those in the other system. Further, if it is desirable to increase the force of the steam ejected from the nozzles, de Laval nozzles may be used. Moreover the skilled person realizes that there are a big variety of options for optimizing the operation of the sootblowing system, by means of using a computerized automated control system being supplied with sensing signals of a big variety of possible sensor devices, e.g. u values, optical sensors sensing position of different objects, temperature sensors, pressure sensors, inductive sensors, etc. Moreover, it is evident that the invention is not restricted to use for recovery boilers, but that it may provide corresponding advantages also in other applications where similar problems exist, e.g. other type of boilers and/or chemical reactors. Nor is the invention restricted to use of steam as cleaning/cooling media, but as is evident also other medias may be used, e.g. air as cooling media.

The present invention is designed to be easy to install, wherein any of the following distinctive features may be mentioned:

Simple design with low cost per unit.

Simple to mount mechanically.

Requires little or no extra electrical feed (or electrical signals).

Restricted modification in existing control programs and installations.

A user or operator may probably experience one or more of the following benefits:

Easy to adjust soot removal so that maximum availability can be attained at minimum steam cost/consumption.

Increased availability to the recovery furnace, which can be utilized for increased production of chemicals and steam.

Reduced consumption of steam (increased total efficiency of the recovery furnace).

Quick pay-off based on steam flow and internal steam price.

Clear and distinct installation project with low risk.

The invention claimed is:

1. A recovery furnace comprising:

a plurality of sootblowers, wherein a first sootblower comprising:

a first frame, a first moveable carriage supported by the first frame, a first motor for moving the first carriage, a first lance tube mounted on the first carriage to be insertable into and retractable from the recovery furnace, wherein the first lance tube having a first valve mounted thereon;

a second sootblower comprising:

a second frame, a second moveable carriage supported by the second frame, a second motor for moving the second carriage, a second lance tube mounted on the second carriage to be insertable into and retractable from the recovery furnace, wherein the second lance tube having a second valve mounted thereon, wherein said first and second lance tubes each having at least one associated nozzle, and a steam feed tube connected to the first and second valves for feeding steam to be ejected through said at least one nozzles into the recovery furnace, and a control system/arrangement constructed for admitting steam through said at least one nozzle only when the carriage with the lance tube is in an active position, wherein in a plurality of the steam feed tubes, each of the first and second sootblowers having an associated directionally controlled valve provided upstream of the first valve, wherein the control system/arrangement permitting a start of the sootblowing action of a sootblower at an arbitrary point of time between when a retraction of a preceding sootblower starts and when the retraction is completed.

2. The recovery furnace according to claim 1, wherein said control system arrangement includes sensing means arranged to identify a position or direction of movement of said lance tube.

3. The recovery furnace according to claim 2, wherein said sensing means includes electronic or optical sensing means.

4. The recovery furnace according to claim 1, wherein said control system/arrangement is/are arranged to control so that only one of the directionally controlled valves is open.

5. The recovery furnace according to claim 1, wherein said control system/arrangement includes a central control unit.

6. The recovery furnace according to claim 1, further comprising the directionally controlled valve and a throttled bypass arranged to permit a reduced flow of steam to pass by, or through, the directionally controlled valve to cool the lance tube when the directionally controlled valve is in its closed state.

7. The sootblowing system as claimed in claim 1, further comprising closure means that facilitates closure of said first and second valves also when the lance tube is in its activated position.

8. The sootblower system according to claim 7, wherein said closure means is mechanically connected to a position indicating device of the sootblower.

9. The sootblower system according to claim 8, further comprising said closure means and said closure means is arranged to facilitate activation of an opening device of the valve when said existing position indicating device is in its activated position, whereas not when said position indicating device is in its inactivated position.

10. A recovery furnace comprising:

a plurality of sootblowers, wherein a first sootblower comprising:

a first frame, a first moveable carriage supported by the first frame, a first motor for moving the first carriage, a first lance tube mounted on the first carriage to be insertable into and retractable from the recovery furnace, wherein the first lance tube having a first valve mounted thereon;

a second sootblower comprising:

a second frame, a second moveable carriage supported by the second frame, a second motor for moving the second carriage, a second lance tube mounted on the second carriage to be insertable into and retractable from the recovery furnace, wherein the second lance tube having a second valve mounted thereon, wherein said first and second lance tubes each having at least one associated nozzle, and a steam feed tube connected to the first and second valves for feeding steam to be ejected through said at least one nozzles into the recovery furnace, and a control system/arrangement constructed for admitting steam through said at least one nozzle only when the carriage with the lance tube is in an active position, wherein in a plurality of the steam feed tubes, said first second valves each comprise a directionally controlled valve, wherein the control system/arrangement permitting a start of the sootblowing action of a sootblower at an arbitrary point of time between when a retraction of a preceding sootblower starts and when the retraction is completed.

11. The sootblowing system as claimed in claim 10, further comprising closure means that facilitates closure of said first and second valves also when the lance tube is in its activated position.

12. The sootblower system according to claim 10, wherein said closure means is mechanically connected to a position indicating device of the sootblower.

13. The sootblower system according to claim 12, further comprising said closure means and said closure means is arranged to facilitate activation of an opening device of the valve when said existing position indicating device is in its activated position, whereas not when said position indicating device is in its inactivated position.

* * * * *